US009756907B2

(12) United States Patent
Frei

(10) Patent No.: US 9,756,907 B2
(45) Date of Patent: Sep. 12, 2017

(54) QUICK LOCK FOR ATTACHING ONE END OF A BAND TO AN OBJECT

(71) Applicant: Stephan Hugo Frei, Singapore (SG)

(72) Inventor: Stephan Hugo Frei, Singapore (SG)

( * ) Notice: Subject to any disclaimer, the term of this patent is extended or adjusted under 35 U.S.C. 154(b) by 0 days.

(21) Appl. No.: 15/281,610

(22) Filed: Sep. 30, 2016

(65) Prior Publication Data

US 2017/0013921 A1 Jan. 19, 2017

Related U.S. Application Data

(63) Continuation of application No. PCT/SG2014/000304, filed on Jun. 26, 2014.

(51) Int. Cl.
*A44C 5/14* (2006.01)

(52) U.S. Cl.
CPC ..... *A44C 5/145* (2013.01); *A44C 5/14* (2013.01)

(58) Field of Classification Search
CPC ..... A44C 5/145; A44C 5/14; Y10T 24/4718; Y10T 24/4782; G04B 37/1486; G04B 37/16
USPC ..... 24/265 B
See application file for complete search history.

(56) References Cited

U.S. PATENT DOCUMENTS 1,662,628 A * 3/1928 Augenstein ..... A44C 5/145 24/600.9
1,866,670 A * 7/1932 Roy ..... A44C 5/145 224/177
1,892,350 A * 12/1932 Kestenman ..... A44C 5/145 224/177
2,850,783 A * 9/1958 Megar ..... A44C 5/145 24/265 WS
3,251,110 A * 5/1966 Hedu ..... A44B 11/263 24/616
3,678,544 A * 7/1972 Bert ..... A44C 5/14 24/265 B
3,889,323 A * 6/1975 Reith ..... A44C 5/14 224/177
4,217,681 A * 8/1980 Grohoski ..... A44C 5/14 224/164

(Continued)

FOREIGN PATENT DOCUMENTS

WO 9414105 6/1994

OTHER PUBLICATIONS

International Search Report in related application No. PCT/SG2014/000304, dated Mar. 30, 2015.

*Primary Examiner* — Robert J Sandy
*Assistant Examiner* — Jason W San
(74) *Attorney, Agent, or Firm* — Dowell & Dowell, P.C.

(57) ABSTRACT

A quick lock device for wristwatch bands comprising: (i) a frame having a pair of overlaps defining a sliding cavity of which cavity is suitable for a sliding movement, one end of the frame being an extension to form an elongated hooking member having a groove along the axis thereof and a latch being formed on the surface of the guiding cavity; and (ii) a sliding member adapted to slide within the cavity being provided with a tongue section at one end of the member and a slide handle to facilitate the sliding movement of the sliding member within the frame, and a latching recess along the axis of the slide, thereby the tongue of the sliding member locks a pin member of a wristwatch being positioned within the groove of the hooking member by sliding the slide handle towards the body of the wristwatch.

20 Claims, 5 Drawing Sheets

(56) References Cited

U.S. PATENT DOCUMENTS 4,231,502 A * 11/1980 Meyerson ..... A44C 5/14 224/177
4,266,326 A * 5/1981 Hong ..... A44C 5/14 224/177
4,414,719 A * 11/1983 Capolupo ..... A44C 5/14 224/164
4,432,476 A * 2/1984 Yokosuka ..... A44C 5/14 224/164
4,593,440 A * 6/1986 Tsamas ..... A44C 5/2071 24/265 WS
4,605,312 A * 8/1986 Sellier ..... G04B 37/1486 224/177
5,175,912 A 1/1993 Chevalley et al.
5,483,505 A * 1/1996 Cartier ..... G04B 37/1493 224/164
5,577,779 A * 11/1996 Dangel ..... E05C 19/06 220/326
5,914,913 A * 6/1999 Shriqui ..... A44C 5/14 224/164
6,176,612 B1 * 1/2001 Chagnoux ..... A44C 5/14 224/168
6,328,188 B1 * 12/2001 Boznos ..... A44C 5/107 224/164
6,389,653 B1 * 5/2002 Matoba ..... A44B 11/006 24/265 AL
6,408,491 B2 * 6/2002 Guyard ..... G04B 37/1486 24/265 WS
6,810,564 B2 * 11/2004 Chan ..... A44C 5/24 24/265 WS
7,249,398 B2 * 7/2007 Roy ..... G04B 37/1486 24/265 B
7,293,332 B2 * 11/2007 Maillard ..... A44C 5/14 24/265 B
7,380,979 B2 * 6/2008 Hiranuma ..... A44C 5/14 224/180
7,412,755 B2 * 8/2008 Tetu ..... A44C 5/24 24/265 WS
7,480,967 B2 * 1/2009 Kojoori ..... A44B 11/006 2/322
7,509,712 B2 * 3/2009 Sima ..... A44C 5/147 24/265 WS
7,526,840 B2 * 5/2009 Pernu ..... A44C 5/14 24/265 WS
8,789,245 B2 * 7/2014 Leger ..... A44C 5/246 24/265 WS
9,010,593 B2 * 4/2015 Tschumi ..... G04B 37/1486 224/164

* cited by examiner

QUICK LOCK FOR ATTACHING ONE END OF A BAND TO AN OBJECT

BACKGROUND OF THE INVENTION

1. Field of the Invention

The present invention generally concerns a mechanism as part of a band, and in particular, to quick lock fastening mechanism for fastening or unfastening a band to or from an object, for instance a wristwatch.

2. Description of the Prior Art

Objects like personal timepieces, or watches, have long been worn upon the wrist. Many of these new devices also perform, sometimes as a relatively minor feature, the timekeeping function of a standard wristwatch.

U.S. Pat. No. 5,175,912 discloses a fastener for connecting a wristwatch strap having two ends to opposite sides of a watch case comprising two arcuate catch elements articulated to opposite sides of the watch case, each catch element being provided with guide means extending longitudinally of the strap and two end engagement members articulated to opposite sides of the watch case together with a respective catch element, and two slide elements connected to opposite ends of the strap, each slide element being provided with a latch member complementary to a respective end engagement member and being slidable along a respective guide means between an advance position in which the strap is shortest and in which the latch members engage respective engagement members and a retracted position in which the strap is longest, release means being provided for releasing each latch member from a respective engagement member when each slide element is in the advanced position and for enabling each slide element to be released from a respective catch element in the retracted position to unfasten the strap. The patented invention is meant for adjusting the length of the strap and it requires two arcuate elements and allows the lengthening or shortening of the watch strap. The present invention does not require an arcuate element and engage in the shortening or lengthening of strap of a wristwatch.

EP Publication No. 1588641, entitled "Fastening Device For Attaching The End of a Band to An Object", discloses a strap which is joined to a watch with spring pins inserted into recesses provided at extensions located at both sides of the watch. The ends of the strap to be positioned adjacent to the watch are of a curved and concave shape in order to avoid a tolerance between the two parts. In case of a leather strap a reinforcing element is inserted between the upper material and the lining for a better fit.

WO2010/072594 discloses a device for fastening a strap body of a watchband to an object, for example, to a watch case, comprising a cylindrical fastening pin having connecting pegs at both free ends thereof for engaging in the object, wherein at least one connecting peg can be retracted using a lever, characterized in that the free end of the lever comprises a head, which is provided with a cap, wherein the cap is connected to the head in a form-closed manner such that the cap is secured against pulling off. In this patent, the fastening pin of the watch is retracted by moving the lever so as to disengage the strap of the watch.

SUMMARY OF THE INVENTION

Briefly stated, the present invention is embodied by a quick lock device for fastening or unfastening a strap to or from an object, for instance a wristwatch, comprising:

(i) a frame having a pair of frame guide defining a guiding cavity of which the cavity is suitable for sliding movement, one end of the frame being an extension to form an elongated hooking member having a groove perpendicular to the sliding axis, and a latch or the like being formed on the surface of the cavity; and (ii) a sliding member adapted to slide within the cavity being provided with a tongue section at one end of the member and a slide handle to facilitate the sliding movement of the sliding member within the frame, and a latching recess corresponding to the latch of the frame, thereby the tongue of the sliding member locks a pin member of a wristwatch being positioned within the groove of the hooking member by sliding the slide handle towards the body of the wristwatch.

Another main purpose of the present invention is to provide a quick lock device for bands comprising: (i) a frame having a pair of frame guide defining a guiding cavity of which the cavity is suitable for sliding moment, one end of the frame being an extension to form an elongated hooking member having a groove perpendicular to the sliding axis of the sliding element; (ii) a sliding member adapted to slide within the guiding cavity being provided with a tongue section at one end of the member and a slide handle to facilitate the sliding movement of the sliding member within the frame, and (iii) a snap fit means comprising a cut-out along the axis of the sliding member and a protruding element on the frame that retains the sliding movement of the sliding member at the cut-out so as to lock the sliding member in a specific position within the frame, thereby the tongue of the sliding member engages and envelopes a pin member of a wristwatch case being positioned within the groove of the hooking member by sliding the slide handle towards the groove.

Still an object of the present invention is to provide a quick lock device for wristwatch bands, wherein a latch is positioned within the cavity of the frame, and has a truncated edge to facilitate backward movement of the sliding member when the slide handle is being pushed backward away from the groove.

Another object of the present invention is to provide a quick lock device for wristwatch bands, wherein the latching recess is locked onto the latch on the cavity of the frame when the slide handle is pushed toward the wristwatch body over the pin member which is part of the watch case, being recognised as the closed or locked position.

A further object of the present invention is to provide a quick lock device for wristwatch bands, wherein the groove on the hooking member holds the pin member of the wristwatch.

Yet a further object of the present invention is to provide a quick lock device for wristwatch bands, wherein the tongue of the sliding member securely locks the pin member in the groove of the frame.

Still a further object of the present invention is to provide a quick lock device for wristwatch bands, wherein the truncated edge of the resilient member facilitates the backward movement if a force is being applied to backward push the slide handle.

A further object of the present invention is to provide a quick lock device for wristwatch bands wherein the tongue of the sliding member is typically of uniform shape but can be formed as forked, consisting of several engaging sections to the pin member.

Other particularities and advantages of the present invention will become clear from the following description.

DETAILED DESCRIPTION OF THE INVENTION

Figure 1:
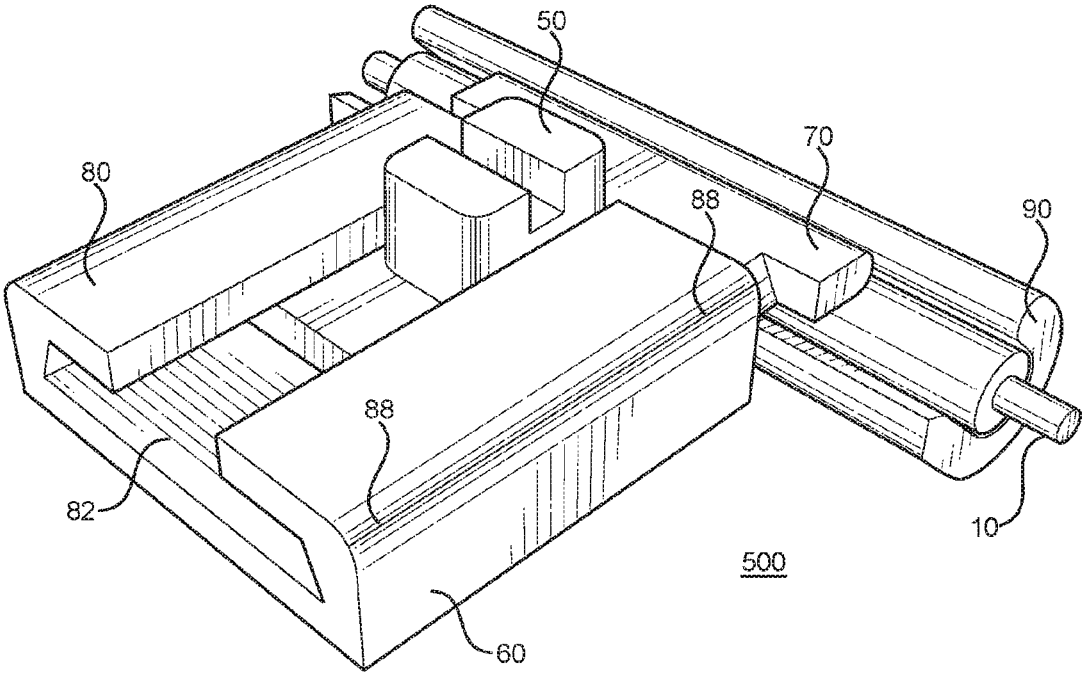
FIG. 1 shows a perspective view of a quick lock device for wristwatch bands in accordance with the present invention.

Referring to FIG. 1, in accordance with the present invention, a quick lock device 500 for wristwatch bands is disclosed, which comprises: (i) a frame 60 having a pair of frame guide 80 defining a guiding cavity 82 of which the cavity 82 is suitable for sliding movement, one end of the frame 60 being an extension to form an elongated hooking member 90 having a groove 65 perpendicular to the sliding axis, and a latch 62 or the like being formed on the surface of the cavity 82; and (ii) a sliding member 600 adapted to slide within the guiding cavity 82 being provided with a tongue section 70 at one end of the sliding member 600 and a slide handle 50 on the top of the sliding member 600 to facilitate the sliding movement of the sliding member 600 within the frame 60, and a latching recess 92 formed on the surface of the sliding member 600 corresponding to the latch 62 on the guiding cavity 82, thereby the tongue section 70 of the sliding member 600 locks a pin member 10 of a wristwatch strap 100 being positioned within the groove 65 of the hooking member 90 by sliding the slide handle 50 towards the body of the wristwatch.

In a preferred embodiment in accordance with the present invention, the quick lock device 500 is embedded within the wristwatch band or the like and at one end thereof and close towards the direction of the watch body. The quick lock device 500 is completely hidden and is not visible and thus the quick lock device 500 shall not alter the entire shape and look of the wristwatch band.

On the wrist watch in general, a pin member 10 (as shown in FIG. 1) is located at the wristwatch strap linkage, and a typical wrist watch comprises a pin member, a multiple part mechanism that catches and/or secures or releases the band or the like from the watch body.

Figure 2:
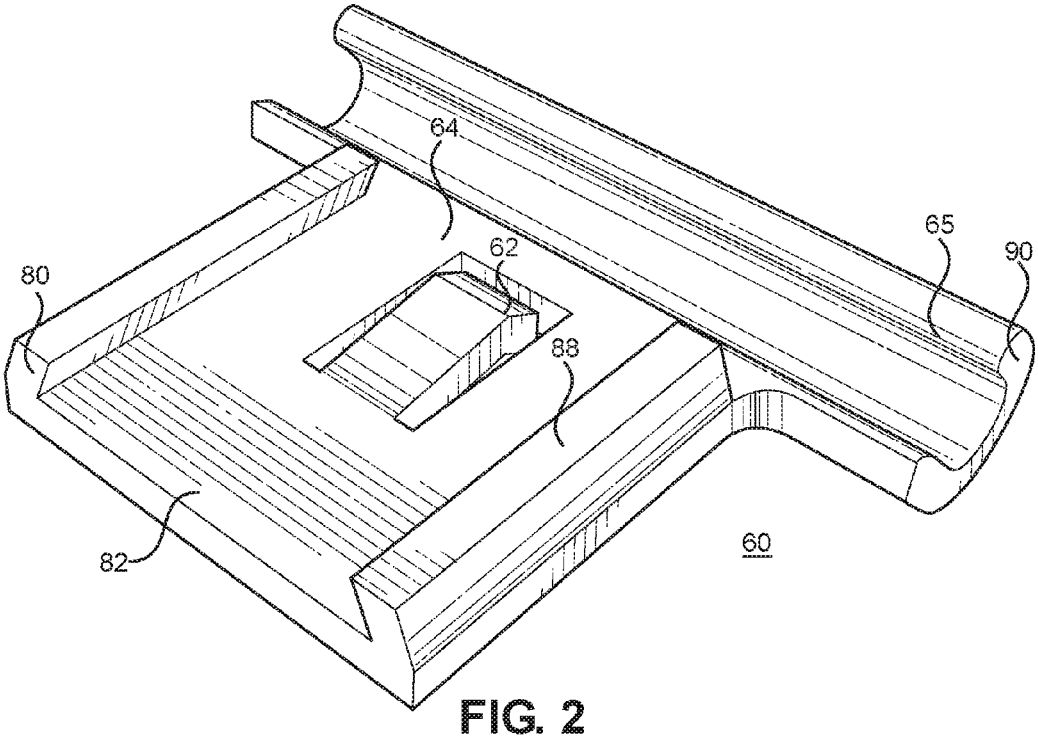
FIG. 2 shows a perspective view of a frame of the quick lock device, in accordance with the present invention.

FIG. 2 shows a perspective view of a frame 60 of the quick lock device 500 in accordance with the present invention. The frame 60 is generally a T-shaped structure and has a pair of frame guide 80. The frame guide 80 defines a sliding cavity 82 of which the cavity 82 is suitable for a sliding movement. In accordance with the preferred embodiment, one end of the frame 60 is an extension to form an elongated hooking member 610 having a groove 65 perpendicular to the sliding axis of the sliding member 600. Generally, the groove 65 takes the shape of the pin member 10 of the wristwatch or the like.

Figure 2A:
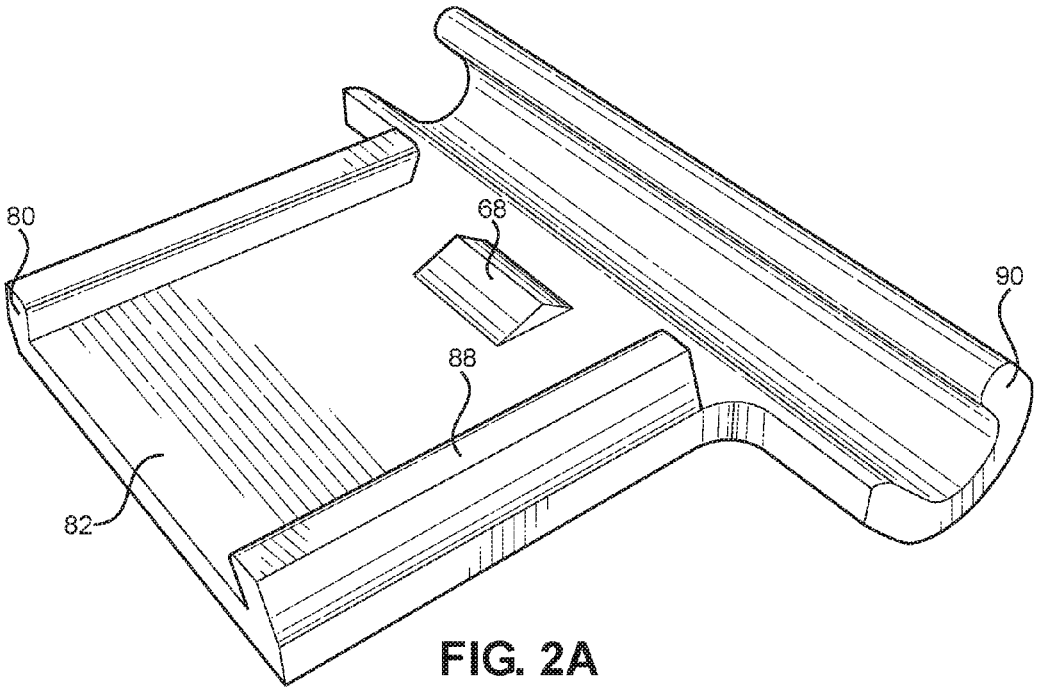
FIG. 2A shows a perspective view of a frame of the quick lock device of another preferred embodiment of the present invention.
Figure 3:
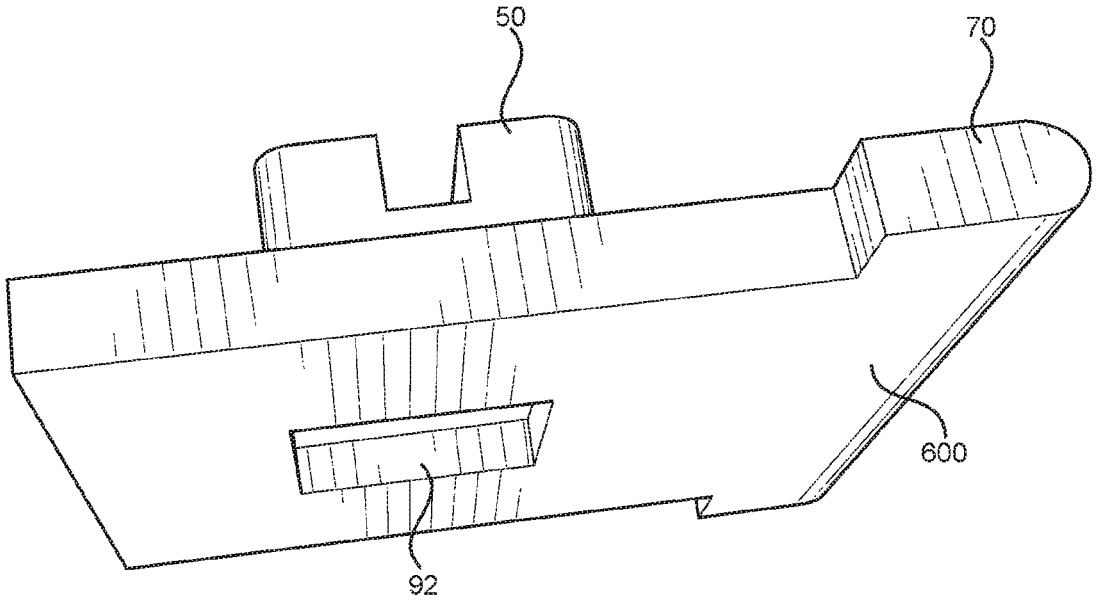
FIG. 3 shows a perspective view of a sliding member of the quick lock device in accordance with the present invention.

In the preferred embodiment as shown in FIGS. 2 and 3, a snap fit means having a cut-out 92 along the axis of the sliding member 600 and a latch 62 or a protruded element or the like that retains the sliding movement of the sliding member 600 at the cut-out 92 so as to lock the sliding member 600 together with the frame 60. In another alternative, as shown in FIG. 2A, the snap fit means having a ridge-like protrusion 68 to retain the sliding movement of the sliding member 600 at the cut-out 90 so as to lock the sliding member 600 together with the frame 60. Thus, the tongue 70 of the sliding member 600 locks the pin member 10 of a wristwatch being positioned within the groove 65 of the hooking member 90 by sliding the slide handle 50 towards the body of the wristwatch.

Figure 3A:
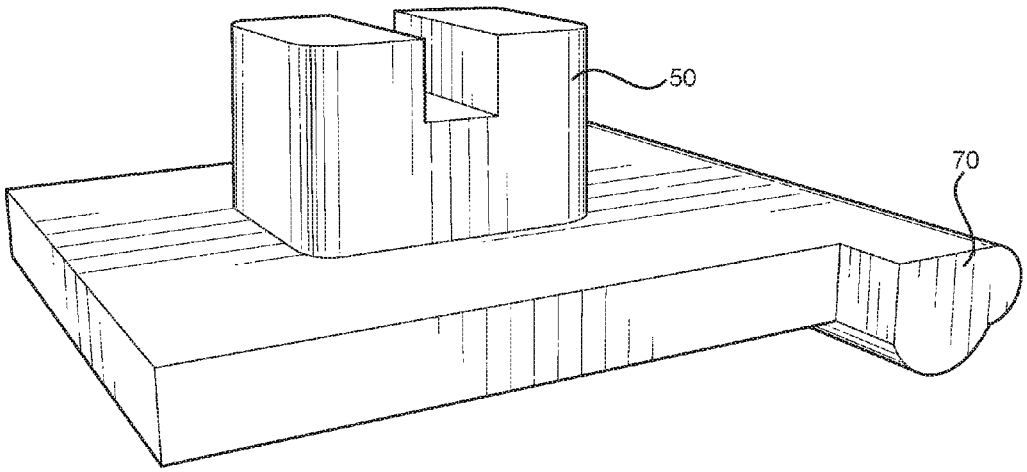
FIG. 3A shows a perspective view of a sliding member of the quick lock device, wherein the tongue is of a thickened convex profile to sit on the groove of the hooking member, in accordance with the present invention.
Figure 3B:
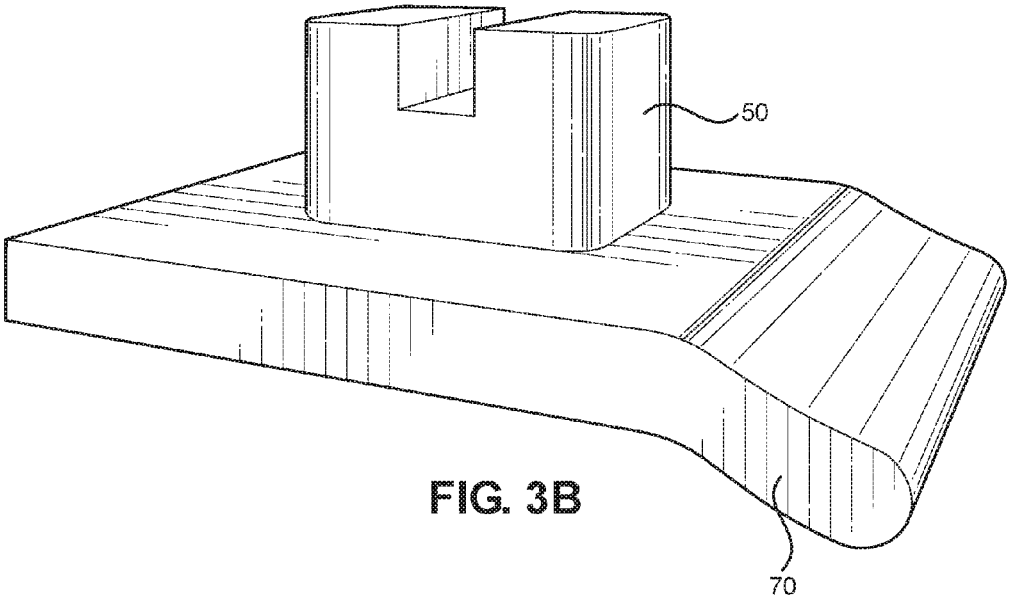
FIG. 3B shows a perspective view of a sliding member of the quick lock device, wherein the tongue is of a suitably shaped downward form to sit on the groove of the hooking member, in accordance with the present invention.

FIG. 3 shows a perspective view of the sliding member 600 of the quick lock device 500 in accordance with the present invention. The sliding member 600 of the preferred embodiment is adapted to slide within the cavity 82 which is being provided with a tongue section 70 at one end of the member 600. The slide, handle 50 on the top of the member 600 is used to facilitate the sliding movement of the sliding member 600 within the cavity 82 of the frame 60. There is a latching recess 92, thereby the tongue section 70 of the sliding member 600 locks the pin member 10 of a wristwatch being positioned within the groove 65 of the hooking member 90 by sliding the slide handle 50 towards the hooking member 90. FIGS. 3A and 3B are perspective views showing other alternative sliding member 600 of the quick lock device 500 in accordance with the present invention. As shown in the figures, the tongue 70 of the sliding member 60 can be made either of a thickened convex profile or a suitably downward shaped form to sit onto the groove 65 of the hooking member 90. The width of the of the tongue section 70 is wider than the guide section 80 which keeps the sliding member 60 from accidentally falling out towards the backend of the frame.

Figure 4:
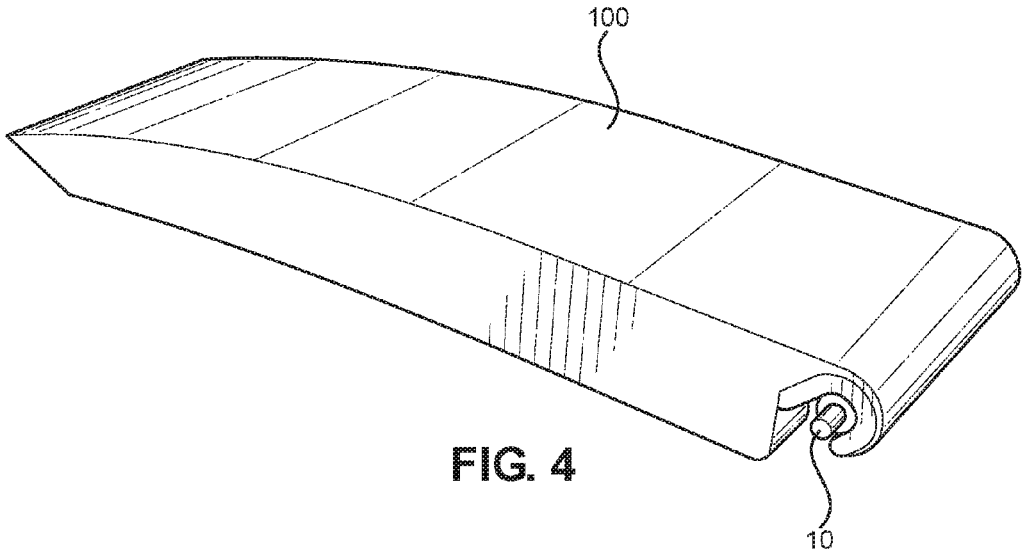
FIG. 4 is a perspective view showing the top view of a watch strap in accordance with the present invention.
Figure 5:
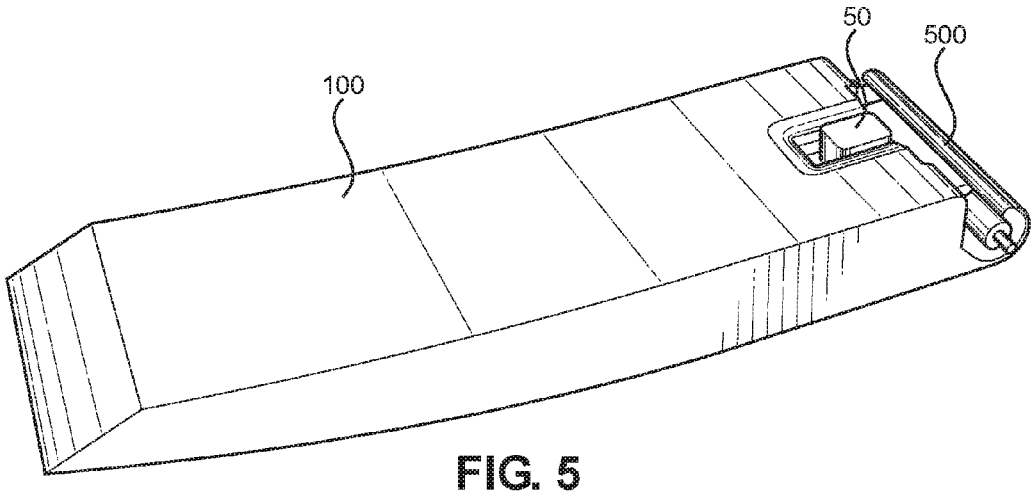
FIG. 5 is a perspective view showing bottom view of a watch strap in accordance with the present invention.

FIG. 4 is a perspective view showing the top view of a watch strap in accordance with the present invention, and FIG. 5 is a perspective view showing bottom view of a watch strap in accordance with the present invention. In accordance with the preferred embodiment of the present invention, the quick lock device 500 is embedded or hidden with the strap 100 of the wristwatch. As it can be seen, the shape and look of the original watch strap 100 is not altered.

In the present preferred embodiment, the latch 62 (FIG. 2) is positioned within the cavity 82 of the frame 500, and has a truncated edge 64 on the latch 62 to facilitate backward movement of the sliding member 600. On the sliding member 600, there is the latching recess 92 on one surface of the sliding member 600, which is corresponding to the latch 62 on the cavity 82 of the frame 500 and locked with each other when the slide handle 50 is pushed toward the wristwatch body and thereby keeping it secured in the forward, closed and secured position.

The pin member 10 on the watch body is seated onto the groove 65 on the hooking member 90 when the quick lock device 500 is triggered to a locking position. At the locking position, the tongue 70 of the sliding member 600 securely locks the pin member 10 in the groove 65 of the frame 60. The truncated edge 64 of the latch 62 facilitates the backward movement only if a sufficient force is being applied to and the slide handle 50 to backward push the slide handle 50.

As shown in FIG. 1, the lateral edge of the frame guide 88 or the frame overlap 80 has a length ranging from 5 mm to 25 mm, preferably is 10 mm, and the thickness of the slide member 600 is ranging from 0.3 mm to 2 mm. The height of the slide handle 50 is ranging from 1.0 mm to 8 mm, which is an appropriate height without increasing the thickness of the strap 100. The overall length of the frame 60 is ranging from 10 to 30 mm, and preferably is 18 mm. The thickness of the frame 60 is ranging from 0.3 mm to 3 mm.

In the preferred embodiment of the present invention, the width of the frame guide 80 is ranging from 5 mm to 25 mm.

In the present invention, after the sliding member 600 is at the locking position, the latch 62 will prevent the accidentally disengagement of the strap 100 from the watch body. In other words, the pin member 10 will be precisely held within the groove 65. The width of the frame overlap 80 gives a suitable tolerance for the slide handle 50 to operate smoothly within the frame guide 88 of the frame 60.

In another preferred embodiment, the shape of the frame 60 can be flat or curved or convex towards the side of slide handle 50. A suitable material for the fabrication of the quick lock can be metal, plastics or any composite materials.

The invention is by no means limited to the above-described embodiments; on the contrary, many changes can be made to the embodiments while still remaining within the scope of the invention, among others as far as shape and dimensions of the parts used for the realisation of the invention are concerned. One such possible alternation is the integration into bracelets, which consist of interlinked metal elements, whereby the element closest to either side of the watchbody become the respective frame 60 of the invention holding the sliding member 600.

The invention claimed is:

1. A quick lock device of a wristwatch band, comprising:

a frame structure that defines a cavity for receiving a sliding member through a sliding movement of the sliding member, wherein the frame structure comprises:

a hooking member that forms an extension at one end of the frame structure and having a groove that is perpendicular to the sliding movement, and a latch that is formed on a surface of the frame structure within the cavity; and the sliding member that slides in accordance to the sliding movement into the cavity, wherein the sliding member comprises:

a latching recess that corresponds to the latch, a tongue section at one end of the sliding member, and a handle to facilitate the sliding movement of the sliding member in accordance to the sliding movement.

2. The quick lock device as defined in claim 1, wherein the tongue section locks a pin member of a wristwatch when the handle of the sliding member is moved towards the hooking member.

3. The quick lock device as defined in claim 2, wherein the hooking member that forms the extension at the end is an elongated frame structure.

4. The quick lock device as defined in claim 1, wherein a free edge at an end of the latch limits backward movement for the sliding member and allows disengagement by a backward push of the sliding member.

5. The quick lock device as defined in claim 4, wherein the free edge of the latch permits the backward movement upon a backward push of the slide handle.

6. The quick lock device as defined in claim 1, wherein the latching recess is locked onto the latch in the frame when the slide handle is moved towards the hooking member.

7. The quick lock device as defined claim 1, wherein a length of the frame structure ranges between 5 millimeters and 25 millimeters.

8. The quick lock device as defined claim 1, wherein a thickness of the slide member ranges between 0.3 millimeters and 2 millimeters.

9. The quick lock device as defined in claim 1, wherein a height of the slide handle ranges between 1.0 millimeters and 8 millimeters.

10. The quick lock device as defined in claim 1, wherein a length of the frame structure ranges between 10 millimeters and 30 millimeters, a frame structure thickness that ranges between 0.3 millimeters and 3 millimeters, and slide member that travels between 1 millimeters and 3 millimeters.

11. The quick lock device as defined in claim 1, wherein a thickness of the frame structure ranges between 0.3 millimeters and 3 millimeters.

12. The quick lock device as defined in claim 1, wherein a width of a frame guide ranges from 5 millimeters to 25 millimeters.

13. The quick lock device as defined in claim 1, the frame structure including a frame guide structure that defines the cavity.

14. A quick lock device of a wristwatch band, comprising:

a frame structure that defines a cavity for receiving a sliding member through a sliding movement of the sliding member;

a hooking member that forms an extension at an end of the frame structure and having a groove that is perpendicular to the sliding movement through the cavity;

the sliding member that slides in accordance with the sliding movement into the cavity, wherein the sliding member comprises:

a tongue section at one end of the sliding member, and a handle to facilitate the sliding movement of the sliding member in the cavity; and a snap-fit structure comprising a protruded element, located on a surface of the frame structure within the cavity, that retains the sliding member at a cut-out within the sliding member after the tongue section slides towards the hooking member when the handle is pushed towards the hooking member.

15. The quick lock device as defined in claim 14, wherein the protruded element is formed by a latch positioned on the frame structure, the latch having a free edge at an end of the latch that limits backward movement of the sliding member.

16. The quick lock device as defined in claim 15, wherein the free edge permits the backward movement when a backward push is applied to the slide handle of the sliding member.

17. The quick lock device as defined in claim 14, wherein the protruded element is snap-fitted into the cut-out when the slide handle is pushed toward the hooking member.

18. The quick lock device as defined in claim 16, wherein the latch in the frame structure is formed of a resilient material.

19. The quick lock device as defined in claim 14, wherein the groove on the hooking member holds a pin member of a wristwatch and is perpendicular to the sliding movement of the sliding member.

20. The quick lock device as defined in claim 14, wherein the frame structure and the sliding member are formed from a material that is selected from a group of materials consisting of plastics, metals, composite materials or any combination thereof.

* * * * *